US006470520B1

(12) United States Patent
Weismiller et al.

(10) Patent No.: US 6,470,520 B1
(45) Date of Patent: Oct. 29, 2002

(54) BED SECTION ATTACHMENT MECHANISM

(75) Inventors: Matthew W. Weismiller; Doug K. Smith, both of Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 38 days.

(21) Appl. No.: 09/586,443

(22) Filed: Jun. 2, 2000

Related U.S. Application Data

(63) Continuation-in-part of application No. 09/379,446, filed on Aug. 23, 1999.

(51) Int. Cl.[7] ..... A61G 7/015
(52) U.S. Cl. ..... 5/602; 5/624
(58) Field of Search ..... 5/602, 620, 621, 5/624; 292/152, 153, 303, 304

(56) References Cited

U.S. PATENT DOCUMENTS

| | | | | | |
|---|---|---|---|---|---|
| 964,170 | A | * | 7/1910 | Leonard | 5/618 |
| 2,067,891 | A | * | 1/1937 | Comper | 5/602 X |
| 2,120,732 | A | * | 6/1938 | Comper et al. | 5/602 |
| 2,257,491 | A | * | 9/1941 | Armstrong | 5/602 |
| 2,306,031 | A | * | 12/1942 | Anderson et al. | 5/620 X |
| 2,381,633 | A | * | 8/1945 | Young | 292/304 |
| 2,658,211 | A | * | 11/1953 | Bendersky | 5/641 |
| 2,754,142 | A | * | 7/1956 | Baker, Jr. | 292/304 |
| 2,766,463 | A | * | 10/1956 | Bendersky | 5/623 |
| 2,832,655 | A | | 4/1958 | Adolphson | 5/620 X |
| 2,872,259 | A | | 2/1959 | Thorpe | 5/621 X |
| 3,100,129 | A | * | 8/1963 | Adolphson | 297/423.22 |
| 3,226,105 | A | * | 12/1965 | Weickgenannt | 5/624 |
| 3,227,440 | A | * | 1/1966 | Scott | 5/618 |
| 3,318,596 | A | * | 5/1967 | Herzog | 5/619 |
| 3,813,091 | A | | 5/1974 | Metzger | 5/624 X |
| 3,817,512 | A | * | 6/1974 | Torrey | 5/632 |
| 3,845,945 | A | * | 11/1974 | Lawley et al. | 5/602 |
| 3,868,103 | A | * | 2/1975 | Pageot et al. | 5/614 |
| 4,225,126 | A | | 9/1980 | Lee | 5/613 |
| 4,323,060 | A | * | 4/1982 | Pecheux | 602/33 |
| 4,333,638 | A | | 6/1982 | Gillott | 5/620 X |

(List continued on next page.)

FOREIGN PATENT DOCUMENTS

| | | | |
|---|---|---|---|
| DE | 2324486 | * | 12/1973 |
| FR | 2666013 | | 2/1992 |
| FR | 1518724 | * | 12/1996 |
| GB | 2225228 A | | 5/1990 |
| JP | 56-109663 | * | 8/1981 |
| JP | 60-85749 | * | 5/1985 |
| JP | 60-195018 | | 12/1985 |
| JP | 61-22577 | | 6/1986 |
| JP | 61-119257 | | 6/1986 |
| JP | 61-168351 | | 7/1986 |
| JP | 61-44019 | * | 10/1986 |
| JP | 61-50626 | * | 11/1986 |
| JP | 2-147120 | | 12/1990 |
| JP | 2-297366 | | 12/1990 |
| JP | 2-297367 | | 12/1990 |
| JP | 2-297368 | | 12/1990 |
| JP | 3-4808 | | 1/1991 |
| JP | 3-4809 | | 1/1991 |
| JP | 5-31145 | | 2/1993 |
| JP | 6-12755 | | 4/1994 |
| JP | 7-112012 | | 5/1995 |

*Primary Examiner*—Robert G. Santos
(74) *Attorney, Agent, or Firm*—Bose McKinney & Evans LLP

(57) ABSTRACT

A birthing bed includes a patient support having a central opening into which a removable foot section is inserted. A foot section attachment mechanism is provided for attaching the foot section to the patient support.

42 Claims, 11 Drawing Sheets

U.S. PATENT DOCUMENTS 4,411,035 A 10/1983 Fenwick ..... 5/602
4,426,071 A 1/1984 Klevstad ..... 5/602
4,552,348 A 11/1985 Forssmann et al. ..... 4/560
4,564,164 A 1/1986 Allen et al. ..... 248/118
4,577,730 A 3/1986 Porter ..... 188/67
4,615,058 A 10/1986 Feldt ..... 5/602
4,632,349 A 12/1986 Anstey ..... 248/281.11
4,682,376 A 7/1987 Feldt ..... 5/602
4,688,780 A 8/1987 Hanz ..... 5/621
4,698,837 A 10/1987 Van Steenburg ..... 378/208
4,724,555 A 2/1988 Poehner et al. ..... 5/624
4,807,618 A 2/1989 Auchinleck et al. ..... 128/878
4,886,258 A 12/1989 Scott ..... 5/624
4,894,876 A 1/1990 Fenwick ..... 5/602
4,898,491 A 2/1990 Van Steenburg ..... 403/96
4,940,218 A 7/1990 Akcelrod ..... 5/621
4,993,762 A 2/1991 Rogers et al. ..... 292/303
5,039,167 A 8/1991 Sweet ..... 297/423.37
5,104,363 A 4/1992 Shi ..... 482/73
5,116,008 A 5/1992 Allen ..... 248/246.01
5,129,117 A 7/1992 Celestina et al. ..... 5/602
5,134,737 A 8/1992 Wyman ..... 5/620 X
5,148,562 A 9/1992 Borders et al. ..... 5/610
5,157,800 A 10/1992 Borders ..... 5/602
5,201,087 A 4/1993 Wickham et al. ..... 5/610
5,214,812 A 6/1993 Bartow et al. ..... 5/624
5,226,187 A 7/1993 Borders et al. ..... 5/602
5,362,302 A 11/1994 Jensen et al. ..... 601/24
5,472,412 A 12/1995 Knoth ..... 602/26
5,481,770 A 1/1996 Ahlsten ..... 5/625
5,560,577 A 10/1996 Keselman ..... 248/279.1
5,636,899 A 6/1997 Schiff et al. ..... 297/411.36
5,645,079 A 7/1997 Zahiri et al. ..... 5/610
5,661,859 A 9/1997 Schaefer ..... 5/621
5,740,572 A 4/1998 Hannant ..... 5/624
5,774,914 A 7/1998 Johnson et al. ..... 5/602
5,802,641 A 9/1998 Van Steenburg ..... 5/648
5,862,549 A 1/1999 Morton et al. ..... 5/610
5,926,878 A 7/1999 Morton et al. ..... 5/602
5,941,175 A 8/1999 Bannister ..... 108/20
5,961,085 A 10/1999 Navarro et al. ..... 248/279.1
6,058,534 A 9/2000 Navarro et al. ..... 5/648

* cited by examiner

BED SECTION ATTACHMENT MECHANISM

BACKGROUND AND SUMMARY OF THE INVENTION

This application is a continuation-in-part of U.S. application Ser. No. 09/379,446 filed on Aug. 23, 1999.

This invention relates to a birthing bed, and particularly to a removable foot section for a birthing bed. More particularly, this invention relates to an apparatus for attaching a removable foot section to a birthing bed.

Conventional birthing beds typically have a detachable foot section. The removal of the foot section permits a caregiver to slide a stool into the space vacated by the foot section so as to be in position to assist in delivery. After delivery, the foot section is reattached to a patient support deck (hereafter, "the patient support") of the birthing bed. The present invention comprises improvements to such beds.

The present invention will be described primarily as a birthing or delivery bed, but it will be understood that the same may be used in conjunction with any other patient support apparatus, such as a hospital stretcher or an operating table. Also, the present invention will be described primarily as a mechanism for attaching a removable foot section to the patient support such that the foot section extends generally horizontally in the plane of the patient support. But it will be understood that the same may be used for attaching a removable head section or a removable side panel to the patient support such that the removable head section or the removable side panel, as the case may be, extends generally horizontally in the plane of the patient support.

According to an embodiment of the present invention, a patient support apparatus comprises a patient support having a first generally planar surface, a removable section having a second generally planar surface, and an attachment mechanism configured to secure the removable section to the patient support such that the second planar surface of the removable section is aligned generally parallel to the first planar surface of the patient support only when the removable section is fully inserted into the patient support and latched to the patient support.

According to another embodiment of the invention, the foot section must be inserted into the bed at an angle relative to the patient support, and is configured to become generally coplanar with the patient support only when it is fully inserted into the bed.

According to still another embodiment, if the foot section is inserted only a part of the way into the bed and let go, it will assume a non-coplanar position with respect to the patient support. The foot section will become generally coplanar with the patient support only when it is fully inserted into the bed.

According to yet another illustrated embodiment of the present invention, a patient support apparatus comprises a patient support, a removable section, and a latch having interactive members coupled to the patient support and the removable section. The removable section is movable between a first position wherein the removable section is coupled to the patient support by the interactive members and a second position wherein the removable section is spaced apart from the patient support. The removable section is movable from the second position to the first position along an inclined path of travel having both horizontal and vertical components relative to a ground surface.

Additional features of the present invention will become apparent to those skilled in the art upon a consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

The present invention will be described primarily as a birthing or delivery bed, but it will be understood that the same may be used in conjunction with any other patient support apparatus, such as a hospital stretcher or an operating table. Also, the present invention will be described primarily as a mechanism for attaching a removable foot section to the patient support such that the foot section extends generally horizontally in the plane of the patient support. But it will be understood that the same may be used for attaching a removable head section or a removable side panel to the patient support such that the head section or the side panel, as the case may be, extends generally horizontally in the plane of the patient support.

Figure 1:
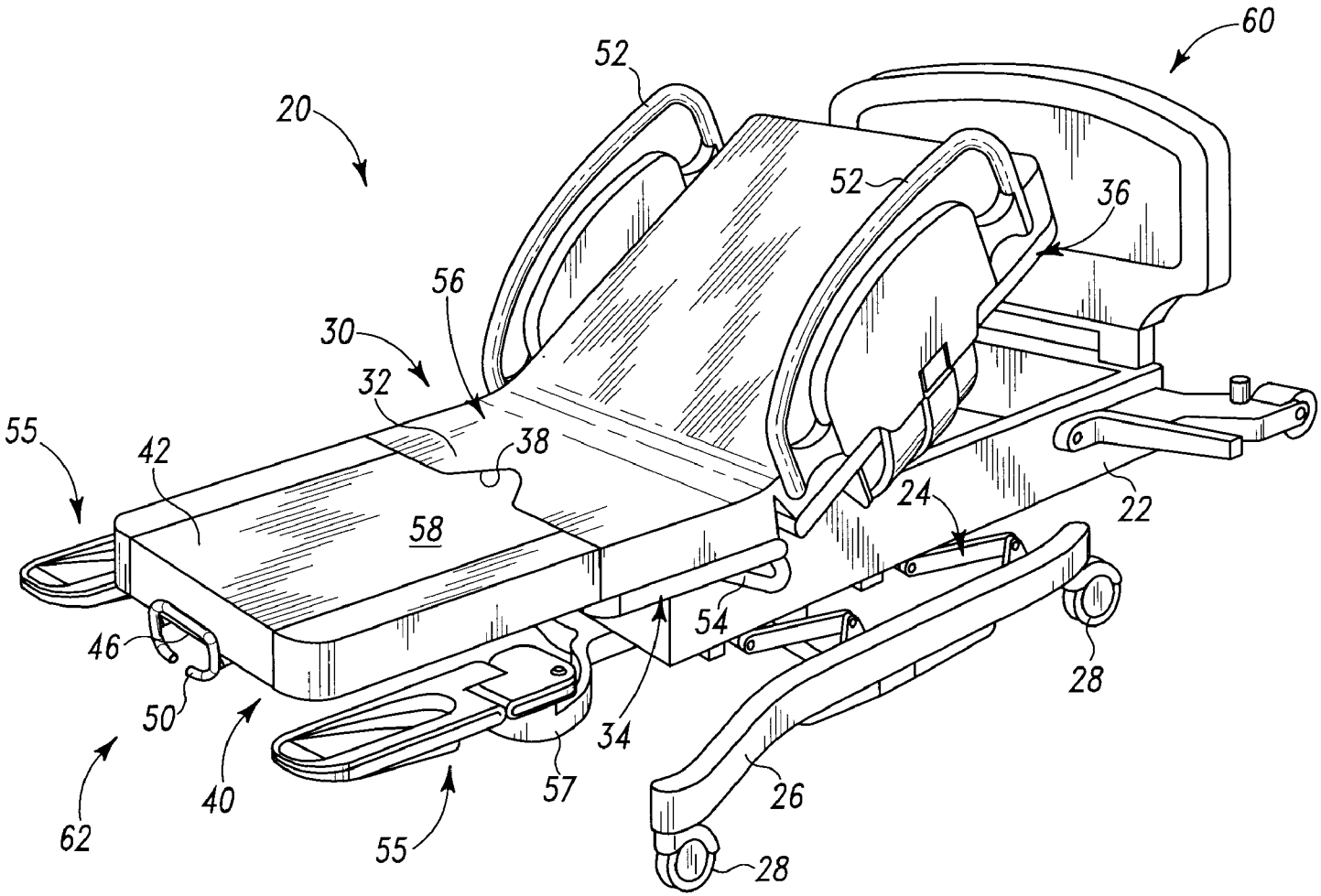
FIG. 1 is a perspective view of a birthing bed showing a removable foot section fully inserted into the bed and latched to the patient support, the foot section extending generally horizontally in the plane of the patient support, and further showing a head section raised to a reclining position.
Figure 2:
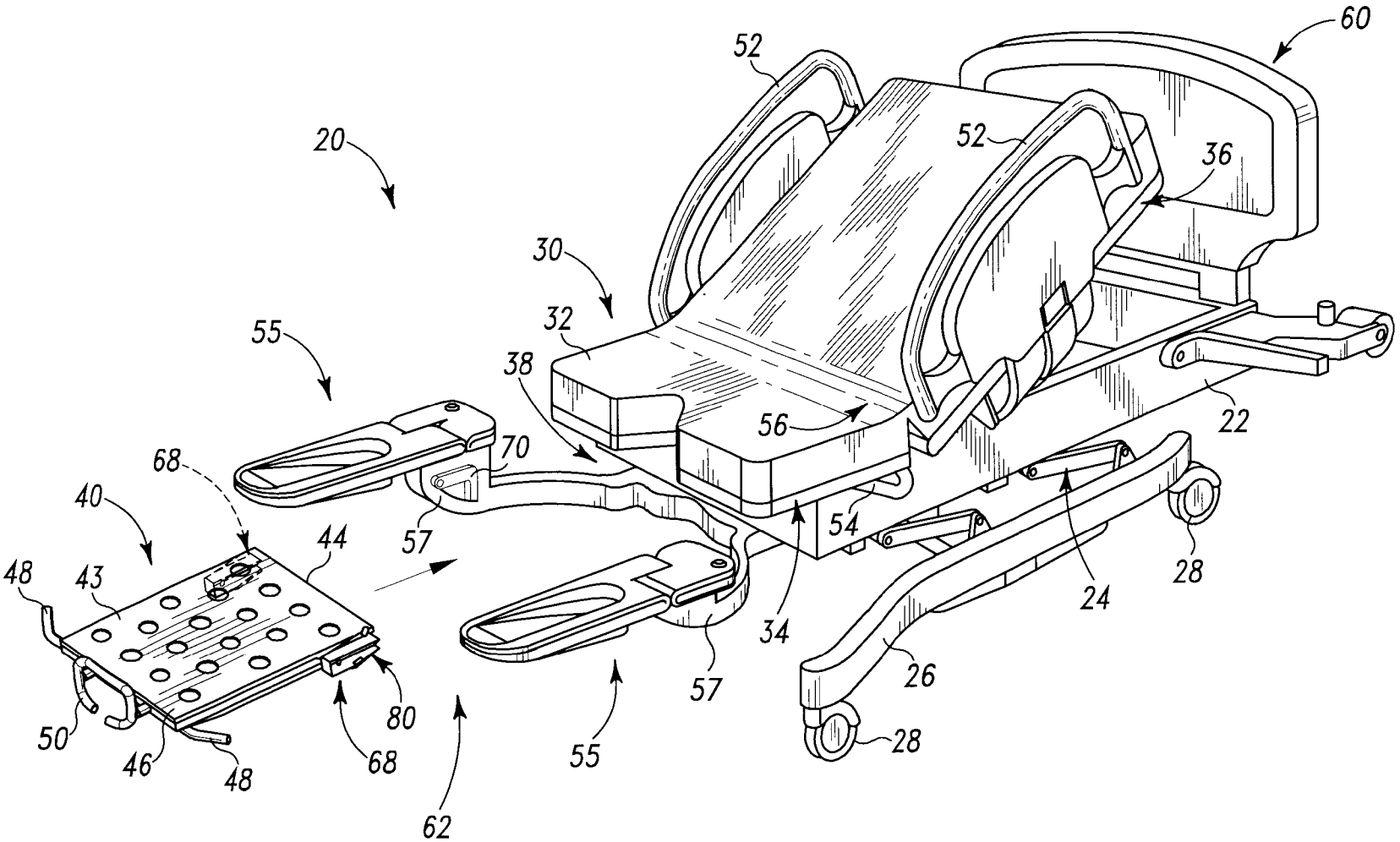
FIG. 2 is a perspective view of a birthing bed similar to FIG. 1, but showing the foot section detached from the seat section.
Figure 3:
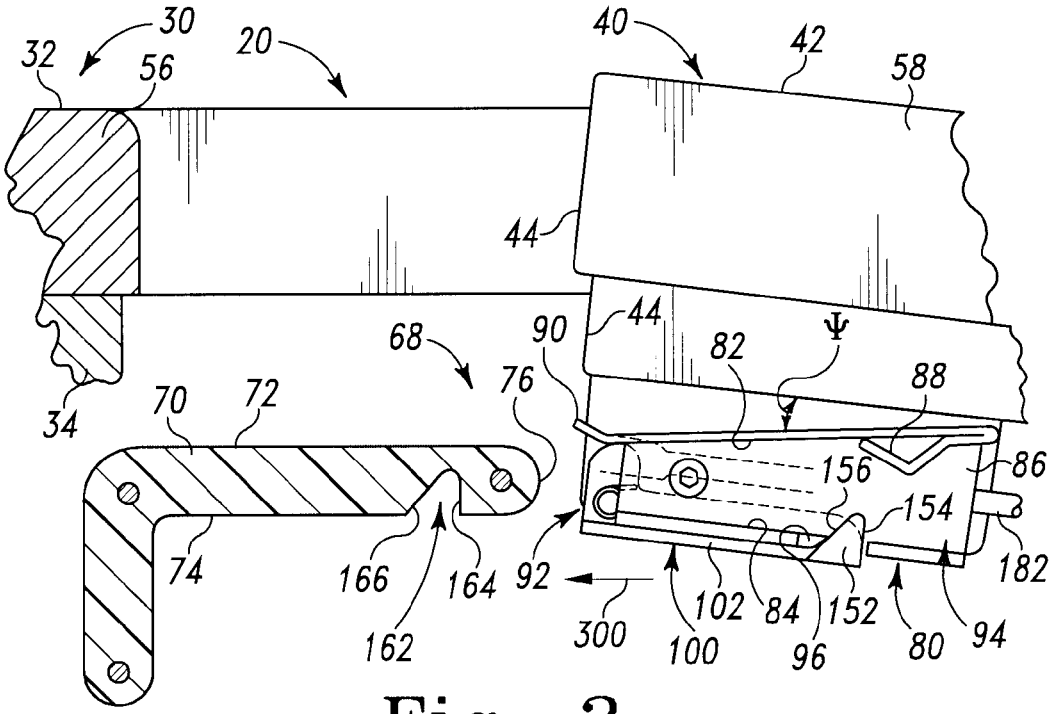
FIGS. 3 is a side elevation view, partly in section, of a portion of the birthing bed showing a foot section attachment mechanism in accordance with an embodiment of this invention, the foot section attachment mechanism including a guide member coupled to the main frame and configured for extending into a diverging guide channel coupled to the foot section when the foot section is inserted into the birthing bed, the diverging guide channel including a ramp portion near the foot end thereof which is configured to engage the guide member when the foot section is inserted into the birthing bed to cause the foot section to align with the patient support, a latch bar pivotally coupled to the foot section is configured to lock the foot section to the patient support when the foot section is fully inserted into the birthing bed and the foot section is aligned with the patient support.
Figure 4:
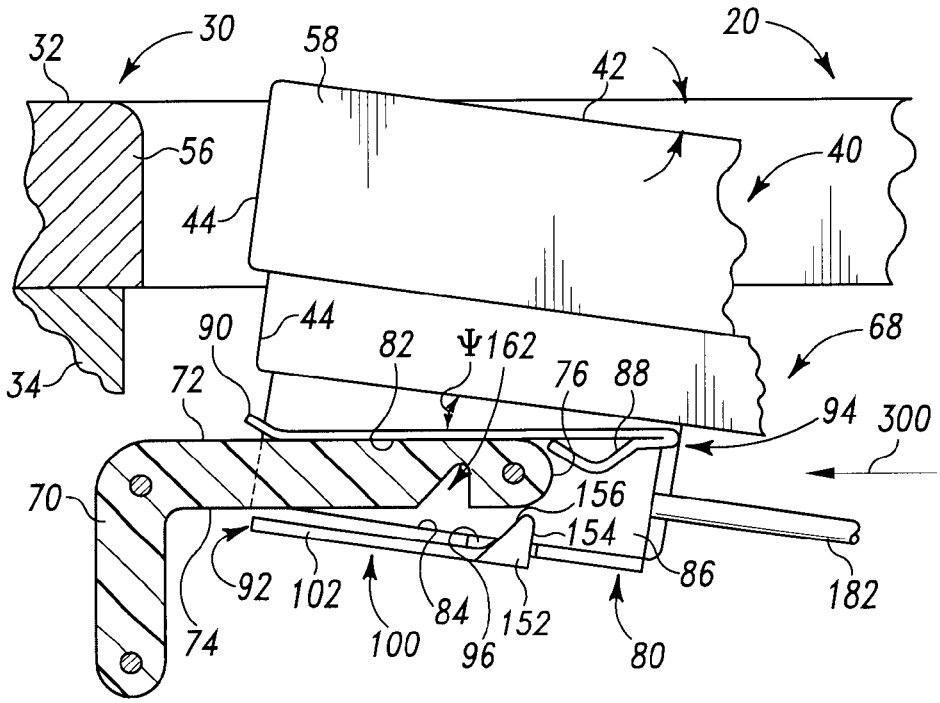
FIGS. 4–6 are side elevation views, partly in section, similar to FIG. 3, and showing a sequence of steps involved in attaching the foot section to the patient support.
Figure 5:
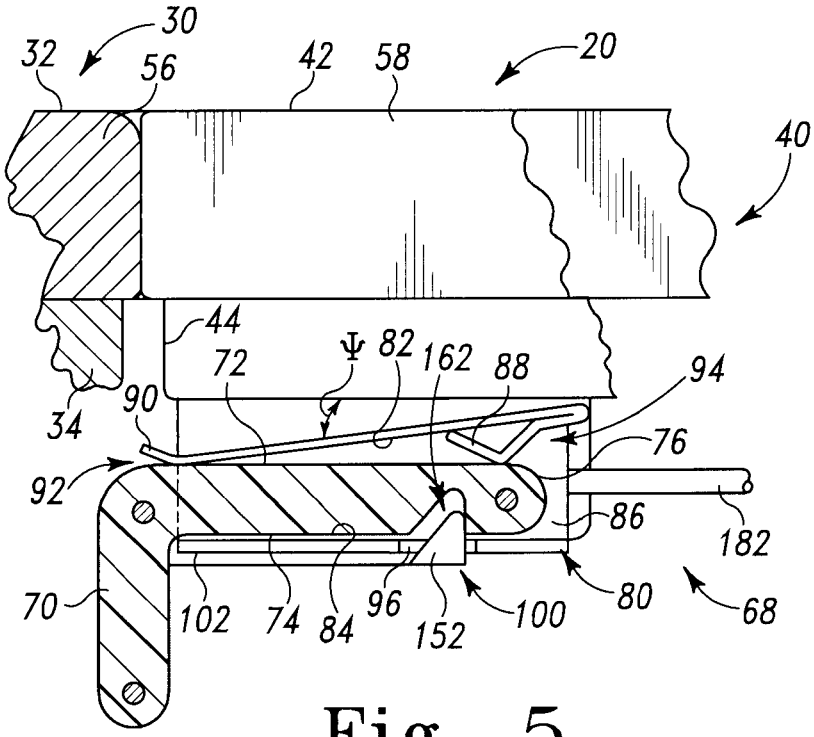

Referring to FIGS. 1 and 2, an illustrative birthing bed 20 is shown having a main frame 22 mounted by a parallelogram linkage 24 to a base frame 26. The base frame 26 has casters 28 for supporting the bed 20 on the floor. The bed 20 includes a patient support deck 30 (hereafter, "the patient support 30") for supporting a mattress 56 on which a patient can rest. The patient support 30 includes a generally horizontal seat section 34 rigidly mounted to the main frame 22. A head section 36 is pivotally mounted to the seat section 34 so that the bed 20 can be articulated between a generally horizontal lying-down position defining a generally horizontal, upwardly-facing surface 32 in the plane of the seat section 34, a generally reclining sitting-up position inclined with respect to the seat section 34, and an infinite number of intermediate positions in between. The seat section 34 includes a central opening 38 into which a removable foot section 40 is inserted such that an upper surface 42 of the foot section 40 extends generally horizontally in the plane of the patient support surface 32 when the foot section 40 is fully inserted into the central opening 38 and latched to the seat section 34. A detachable portion 58 of the mattress 56 is secured to the foot section 40 by any suitable means—such as a plurality of Velcro® fasteners, snaps, ties or the like. Detachable mattress portion 58 is removed from foot section 40 in FIG. 2. Top surface 43 of foot section 40 is configured to be aligned in substantially the same plane as seat section 34 of patient support 30 only when the foot section 40 is fully inserted and latched as discussed below.

Figure 8:
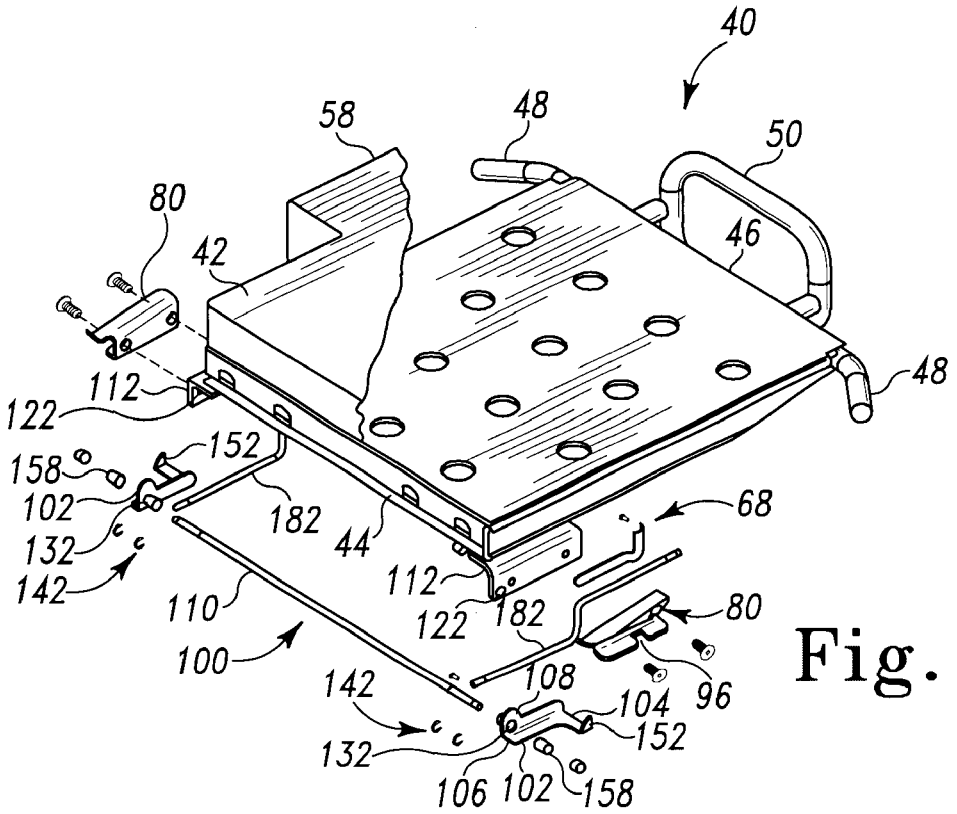
FIG. 8 is an exploded view of the foot section and the foot section locking mechanism.

As shown in FIGS. 2 and 8, the foot section 40 includes a pair of handles 48, one on each side, adjacent to a foot end 46 of the foot section 40. The handles 48 assist the caregiver to pull the foot section 40 away from the bed 20 so that the foot section 40 is detached from the patient support 30 and stored. The foot section 40 includes a floor stand 50 adjacent to the foot end 46 for vertically supporting the foot section 40 on the floor. As used in this description with reference to the bed 20, the phrase "head end" will be used to denote the end of any referred-to object that is positioned to lie nearest the head end 60 of the bed 20, and the phrase "foot end" will be used to denote the end of any referred-to object that is positioned to lie nearest the foot end 62 of the bed 20.

The head section 36 has two siderails 52 mounted thereon, one on each side of the head section 36. Mounted to the underside of the seat section 34 are labor grips 54, one on each side of the bed 20. The labor grips 54 have two principal positions—a vertical operative position projecting substantially perpendicularly to the seat section 34, and a horizontal out-of-the-way storage position tucked underneath the seat section 34. In their vertical operative positions, the labor grips 54 can be gripped by the mother to assist her in generating maximum thrust during delivery. A pair of pivotable foot supports 55 are coupled to supports 57.

FIGS. 3–6 illustrate a foot section attachment mechanism 68 in accordance with an embodiment of the present invention. The foot section attachment mechanism 68 includes two guide members 70 coupled to the supports 57 of the main frame 22, one on each side of the bed 20, and two guide tracks 80 coupled to the foot section 40, one on each side of the foot section 40. Although the guide members 70 are coupled to the main frame 22 in this particular embodiment, they may very well be coupled instead to the seat section 34 which is rigidly mounted to the main frame 22. Since the construction and the operation of the two guide members 70 and the two guide tracks 80 is similar, only one guide member and one guide track will be described herein in the interest of brevity. It will be understood that the construction and the operation of the other guide member and the other guide track is similar. The two guide members 70 and the two guide tracks 80 are sometimes referred to herein as the cooperating engagement members.

The guide track 80 includes a lip or ramp portion 90 near its entrance 92. The ramp portion 90 engages a leading edge 76 of the guide member 70 during insertion of the foot section 40 into the bed 20 to direct the guide member 70 into the guide track 80. The guide member 70 includes a first upwardly-facing surface portion 72 on an upper side thereof and a second downwardly-facing surface portion 74 on an underside thereof, both surface portions 72 and 74 extending generally parallel to the generally horizontal, upwardly-facing surface 32 of the seat section 34. The guide track 80 coupled to the foot section 40 includes a first downwardly-facing surface portion 82 on an upper side thereof extending generally at an angle v with respect to the upwardly-facing surface 42 of the foot section 40 (illustratively, between about 10° and about 30°), and a second upwardly-facing surface portion 84 on a lower side thereof extending generally parallel to the upwardly-facing surface 42 of the foot section 40. The first downwardly-facing surface portion 82 and the second upwardly-facing surface portion 84 of the guide track 80 form a diverging guide channel 86 into which the guide member 70 extends when the foot section 40 is inserted into the bed 20 in the direction of arrow 300. The first generally-inclined, downwardly-facing surface portion 82 of the guide track 80 includes a downwardly-projecting ramp portion 88 near its foot end 94 (sometimes referred to herein as "the inner end"), which engages the leading edge 76 of the guide member 70 when the foot section 40 is inserted into the bed 20 to cause the first generally-inclined, downwardly-facing surface portion 82 of the guide track 80 to move away from the first generally-horizontal, upwardly-facing surface portion 72 of the guide member 70, and to cause the second generally-parallel, upwardly-facing surface portion 84 of the guide track 80 to move closer to the second generally-horizontal, downwardly-facing surface portion 74 of the guide member 70 to, in turn, cause the upwardly-facing surface 42 of the foot section 40 to align in substantially the same plane with the upwardly-facing surface 32 of the patient support 30.

Figure 7:
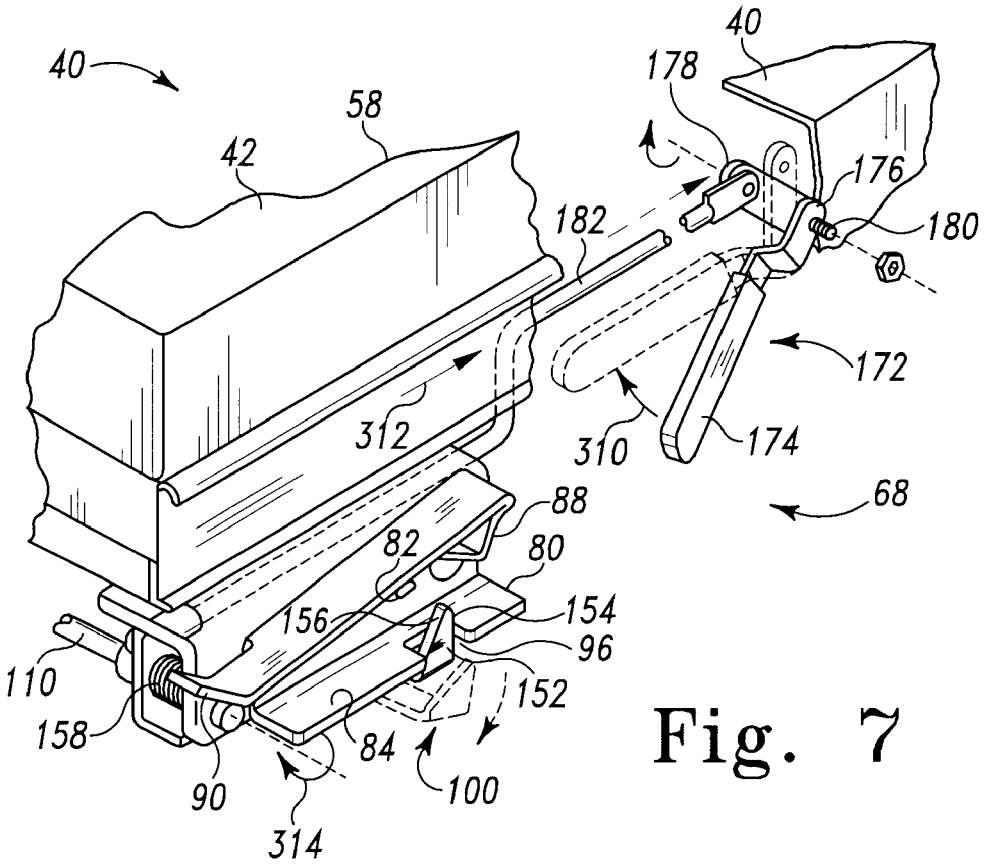
FIG. 7 is a perspective view of the foot section, partly broken away; showing a release handle coupled to the latch bar for releasing the foot section from the patient support.

The foot section 40 includes a foot section locking mechanism 100 best shown in FIGS. 7 and 8. The foot section locking mechanism 100 locks the foot section 40 to the patient support 30 when the foot section 40 is fully inserted into the bed 20 and the upwardly-facing surface 42 of the foot section 40 is aligned with the upwardly-facing surface 32 of the patient support 30. The foot section locking mechanism 100 includes two latch bars 102 pivotally mounted on opposite sides of the foot section 40 by means of a transversely-extending connecting rod 110. Attached to the underside of the foot section 40 near the head end 44 thereof are two downwardly-projecting brackets 112, one on each side of the foot section 40. As shown in FIG. 8, the two ends of the connecting rod 110 are passed through two slightly oversized openings 122 in the downwardly projecting brackets 112 and through two slightly oversized openings 132 in the two latch bars 102, and securely held in place by two sets of C-shaped retaining rings 142—one on each side of the foot section 40.

Since the two latch bars 102 are mirror images of each other, only one latch bar will be described herein in the interest of brevity. It will be understood that the construction and operation of the other latch bar is similar. The latch bar 102 is movable between a first operative position where a generally triangular portion 152 coupled to a first end 104 of the latch bar 102 enters a generally triangular retaining slot 162 in the guide member 70 through an opening 96 in the second upwardly-facing surface portion 84 of the guide track 80 to lock the foot section 40 to the patient support 30 when the foot section 40 is fully inserted into the bed 20 and the upwardly-facing surface 42 of the foot section 40 is aligned with the upwardly-facing surface 32 of the patient support 30, and a second inoperative position where the triangular portion 152 is out of the retaining slot 162 to release the foot section 40. A spring 158 coupled to the latch bar 102 biases the latch bar 102 toward its first operative position. Illustratively, in this embodiment, the triangular portion 152 coupled to the first end 104 of the latch bar 102 is formed integrally therewith.

The triangular portion 152 includes a first generally vertical side 154 adapted for engaging a first generally vertical side 164 of the retaining slot 162, and a second generally inclined side 156 adapted for engaging a second generally inclined side 166 of the retaining slot 162. During attachment of the foot section 40 to the rest of the bed 20, the inclined side 156 of the latch bar 102 cams against the leading edge 76 of the guide member 70 thereby pivoting the latch bar 102 downwardly against the bias of the spring 158 until the triangular portion 152 of the latch bar 102 aligns with the retaining slot 162 in the guide member 70 at which point the spring 158 biases the latch bar 102 upwardly so that the triangular portion 152 is received in the retaining slot 162. Thus, the spring 158 coupled to the latch bar 102 inserts the triangular portion 152 into the retaining slot 162 in the guide member 70 to lock the foot section 40 to the patient support 30 when the foot section 40 is fully inserted into the bed 20 and the upwardly-facing surface 42 of the foot section 40 is aligned with the upwardly-facing surface 32 of the patient support 30. The first vertical side 154 of the triangular portion 162 of the latch bar 102 bears against the first vertical side 164 of the retaining slot 162 in the guide member 70 to prevent extraction of the foot section 40 from the bed 20.

Figure 6:
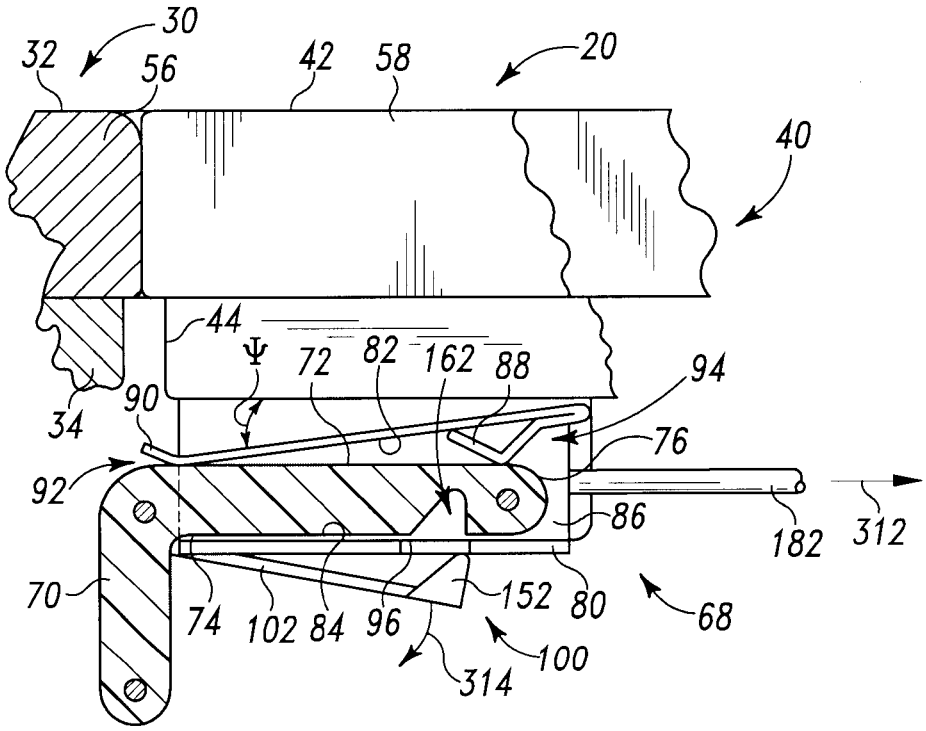

As indicated before, the foot section 40 is detachable from the patient support 30. The removal of the foot section 40 permits a caregiver to slide a stool into the space vacated by the foot section 40 to be in position to assist in delivery. To this end, a foot section release handle 172 is mounted to the foot section 40 adjacent to its foot end 46 as shown in FIGS. 7 and 8. The foot section release handle 172 includes a first portion 174 providing a handle, a middle portion 176 pivotally coupled to the foot section 40 about a transversely-extending pivot pin 180, and a third portion 178 pivotally coupled to a third portion 108 of the latch bar 102 by a longitudinally-extending coupling rod 182. When the release handle 172 is rotated clockwise in the direction of arrow 310, the coupling rod 182 moves outwardly in the direction of arrow 312. As shown in FIGS. 6 and 7, the outward motion of the coupling rod 182, in turn, causes the latch bar 102 to turn clockwise in the direction of arrow 314, whereby the triangular portion 152 coupled to latch bar 102 disengages from the retaining slot 62 to free the foot section 40.

Thus, the foot section attachment mechanism 68 is configured such that the upper surface 42 of the foot section 40 will not become parallel with the upper surface 32 of the seat section 34 until the foot section 40 is fully inserted into the opening 38 in the seat section 34. Upon full insertion of the foot section 40 into the opening 38, the locking mechanism 100 automatically locks the foot section 40 to the rest of the bed 20. Therefore, the foot section attachment mechanism 68 provides the caregiver with a visual indication (i.e., the orientation of the upper surface 42 of the foot section 40) regarding whether the foot section 40 is properly attached to the rest of the bed 20.

Figure 9:
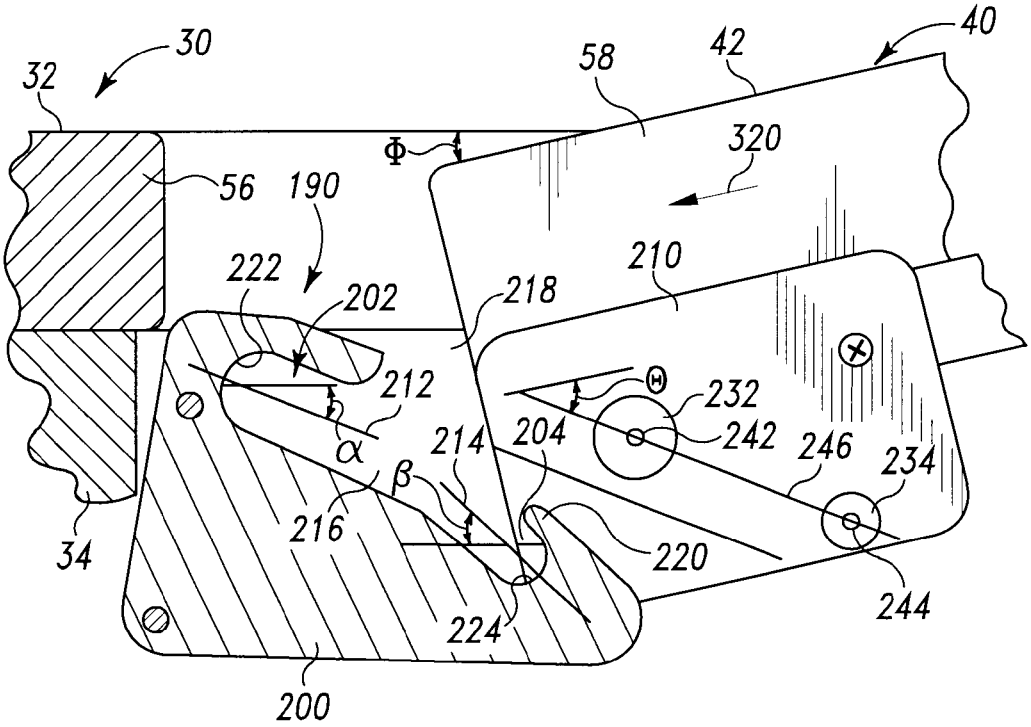
FIGS. 9 and 10 are side elevation views, partly in section, of an alternative embodiment of the present invention comprising two posts attached to the foot section configured for insertion into two oppositely-disposed retaining slots in the patient support to lock the foot section to the patient support, the foot section not aligning with the patient support until the foot section is completely inserted and locked to the patient support.
Figure 10:
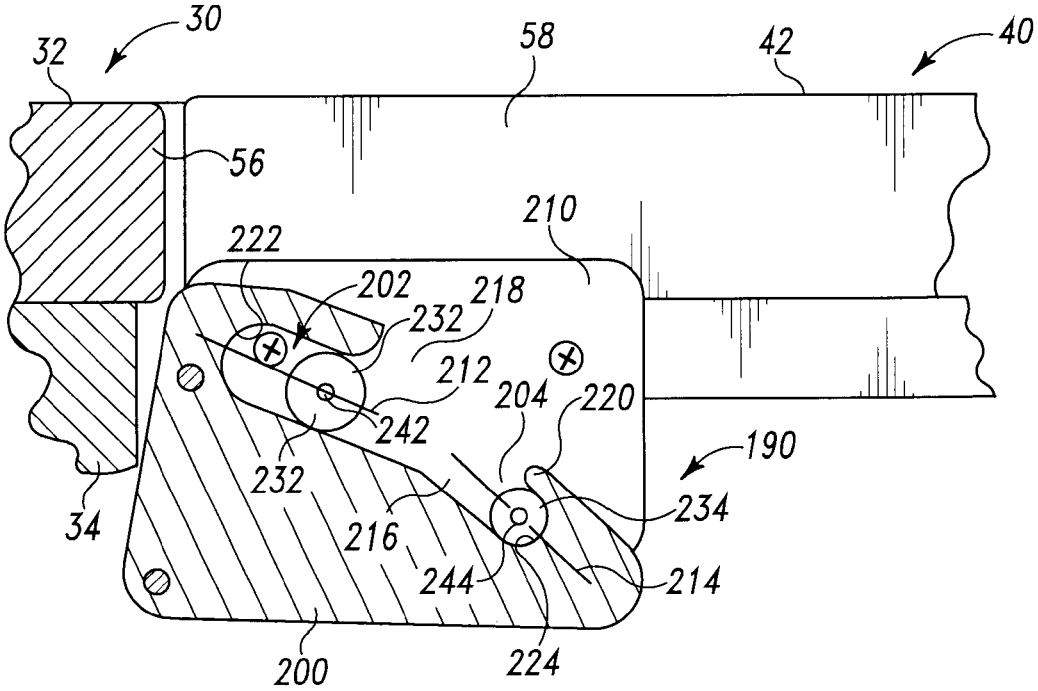

An alternative embodiment of the present invention is shown in FIGS. 9 and 10. As shown therein, a foot section attachment mechanism 190 includes two guide members 200 coupled to the main frame 22, one on each side of the bed 20, and two brackets 210 coupled to the removable foot section 40, one on each side of the foot section 40. Although the guide members 200 are coupled to the main frame 22 in this particular embodiment, they may very well be coupled instead to the seat section 34 which is rigidly mounted to the main frame 22. Since the construction and the operation of the two guide members 200 and the two brackets 210 is similar, only one guide member and one bracket will be described herein. It will be understood that the construction and the operation of the other guide member and the other bracket is similar. The two guide members 200 and the two brackets 210 are sometimes referred to herein as the cooperating engagement or interactive members.

The guide member 200 coupled to the main frame 22 includes two oppositely-disposed retaining slots—a leading forwardly-extending retaining slot 202 extending downwardly toward the foot end 62 of the bed 20, and a trailing rearwardly-extending retaining slot 204 extending upwardly toward the head end 60 of the bed 20. The bracket 210 coupled to the foot section 40, on the other hand, includes two posts—a leading post 232 near the head end 44 of the foot section 40 and a trailing post 234 near the foot end 46 of the foot section 40. The two retaining slots 202 and 204 form a passageway 216 in the guide member 200 that terminates into an opening 218 through which the two posts 222 and 224 enter the two retaining slots 202 and 204 respectively when the foot section 40 is inserted into the bed 20 to lock the foot section 40 to the patient support 30.

As shown in FIGS. 9 and 10, the leading forwardly-extending retaining slot 202 extending downwardly toward the foot end 62 of the bed 20 has a central axis 212 that subtends a first angle $\alpha$ relative to the upwardly-facing surface 32 of the patient support 30. On the other hand, the trailing rearwardly-extending retaining slot 204 extending upwardly toward the head end 60 of the bed 20 has a central axis 214 that subtends a second angle β relative to the upwardly-facing surface 32 of the patient support 30 that is larger than the first angle α. Illustratively, the first angle α is about 30°, and the second angle β is about 45°. The two posts 232 and 234 are mounted to the bracket 210 by respective transversely-extending bolts 242 and 244. The two bolts 242 and 244 lie in a plane 246 that forms a third angle θ relative to the upwardly-facing surface 42 of the foot section 40 that lies between the first angle α and the second angle β. Illustratively, the third angle θ between the plane 246 and the upwardly-facing surface 42 of the foot section 40 is about 37.5°. In the embodiment shown, the leading post 232 is made larger than the trailing post 234, and likewise the leading retaining slot 202 is made larger than the trailing retaining slot 204. This arrangement of unequal posts 232 and 234 and unequal retaining slots 202 and 204 prevents the larger leading post 232 from inadvertently entering the smaller trailing retaining slot 204 during insertion and removal of the foot section 40 into and from the rest of the bed 20.

In operation, as shown in FIG. 9, the foot section 40 is inserted into the bed 20 in the direction of arrow 320 at an angle ϕ, about 30°, to insert the larger leading post 232 into the larger, forwardly-extending retaining slot 202 through the opening 218 in the guide member 200 during forward motion of the foot section 40 toward the head end 60 of the bed 20. After the foot section 40 is fully inserted into the bed 20 so that the larger leading post 232 engages the bottom portion 222 of the forwardly-extending retaining slot 202, it is pivoted downwardly about the larger leading post 232. This downward pivoting of the foot section 40 about the larger leading post 222 allows the smaller trailing post 234 to enter the smaller, rearwardly-extending retaining slot 204 through the opening 218 in the guide member 200. When the foot section 40 is let go thereafter, it moves slightly outwardly toward the foot end 62 as shown in FIG. 10 until the smaller trailing post 234 engages the bottom portion 224 of the rearwardly-extending retaining slot 204. This outward motion of the foot section 40 allows the upwardly-facing surface 42 of the foot section 40 to align with the upwardly-facing surface 32 of the patient support 30, and simultaneously locks the foot section 40 to the patient support 30.

On the other hand, when the foot section 40 is inserted horizontally into the bed 20 in the plane of the upwardly-facing surface 32 of the patient support 30, a lip portion 220 of the guide member 200 near the opening 218 blocks the entry of the trailing post 234 into the passageway 216 in the guide member 200. Thus, the lip portion 220 of the guide member 200 prevents a partial entry of the foot section 40 into the bed 20. The foot section 40 must be inserted into the bed 20 at a certain angle ϕ relative to the upwardly-facing surface 32 of the patient support 30, and will become horizontal only when the foot section 40 is fully inserted into the bed 20 and locked in place.

In the particular embodiment described herein, the leading and trailing retaining slots 202 and 204 are illustratively formed in the guide member 200 secured to the main frame 22. However, the retaining slots 202 and 204 may very well be formed directly in the main frame 22 instead. Although two posts 232 and 234 are secured to the bracket 210 by bolts 242 and 244, the two posts 232 and 234 may be replaced by two rollers and pivotally secured to the bracket 210 by pivot pins instead. Also, the posts 232 and 234 may be directly mounted to the foot section 40.

Figure 11:
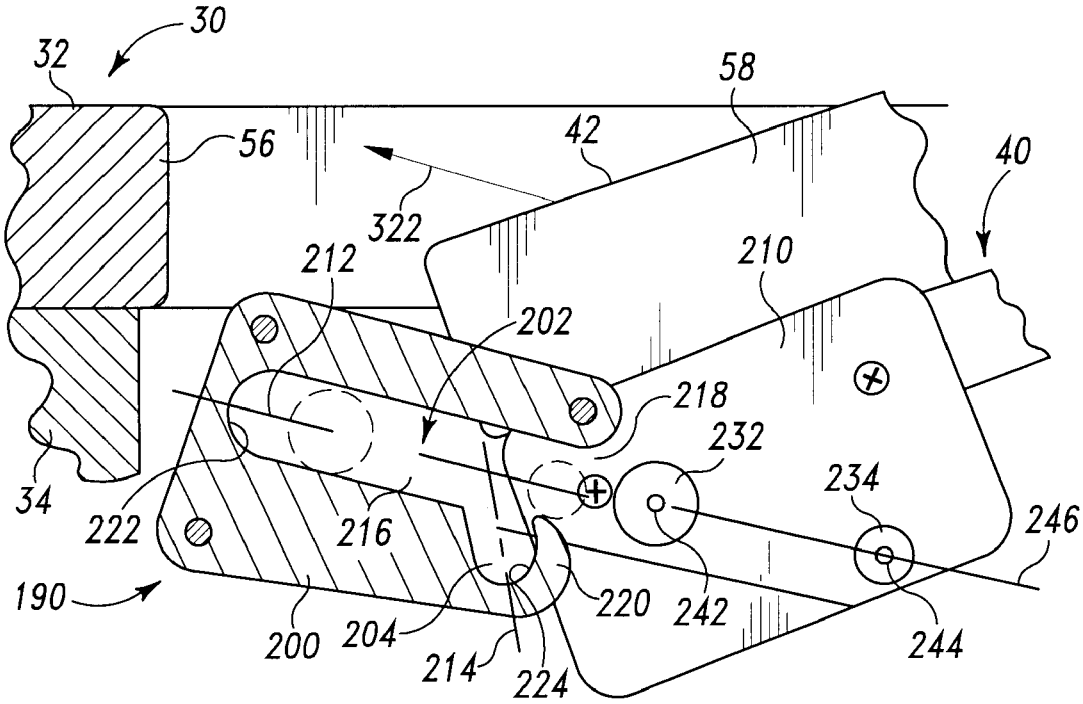
FIGS. 11 and 12 are side elevation views similar to FIGS. 9 and 10, partly in section, of a variation of the alternative embodiment shown in FIGS. 9 and 10.
Figure 12:
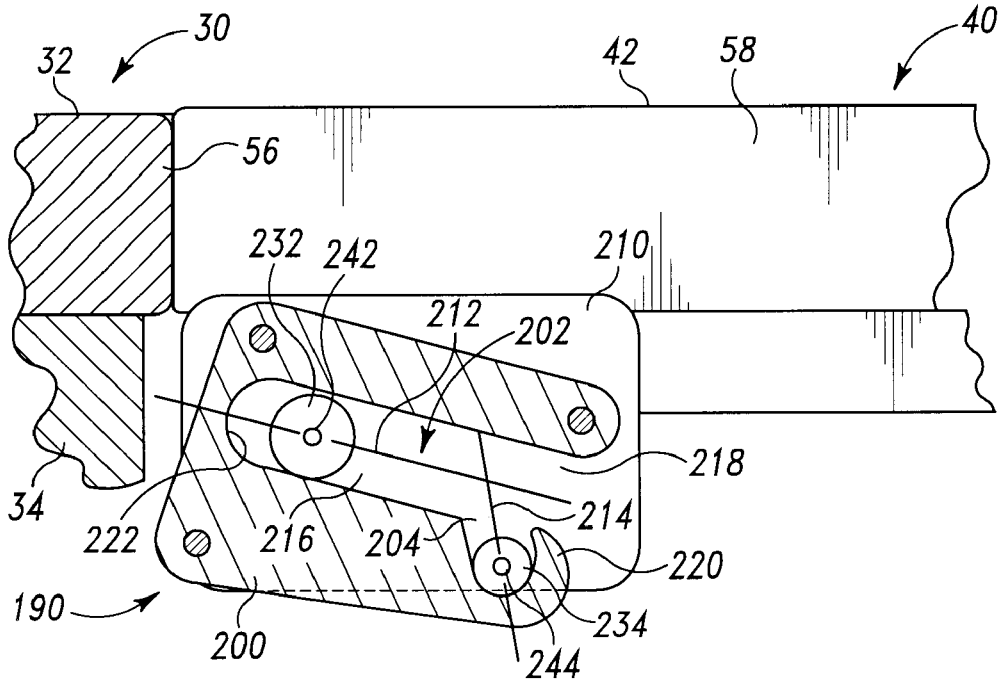

FIGS. 11 and 12 show a variation of the alternative embodiment of the foot section attachment mechanism 190 of FIGS. 9 and 10. The two posts 232 and 234 in the embodiment of FIGS. 11 and 12 are identical to those in the embodiment of FIGS. 9 and 10. The configuration of the retaining slots 202 and 204 is, however, slightly different. The operation of the embodiment of FIGS. 11 and 12 is, however, similar to the operation of the embodiment of FIGS. 9 and 10.

FIGS. 13–18 show an alternative embodiment of a foot section attachment mechanism 368 that is similar to the foot section attachment mechanism 68 shown in FIGS. 2–8. Those elements in FIGS. 13–18 identified by reference numbers identical to FIGS. 2–8 perform the same or similar function. The attachment mechanism 368 includes a first portion 370 coupled to supports 57 and a second portion 372 coupled to foot section 340. In the FIG. 13 embodiment, detachable mattress section 58 is shown removed from the foot section 340.

Figure 13:
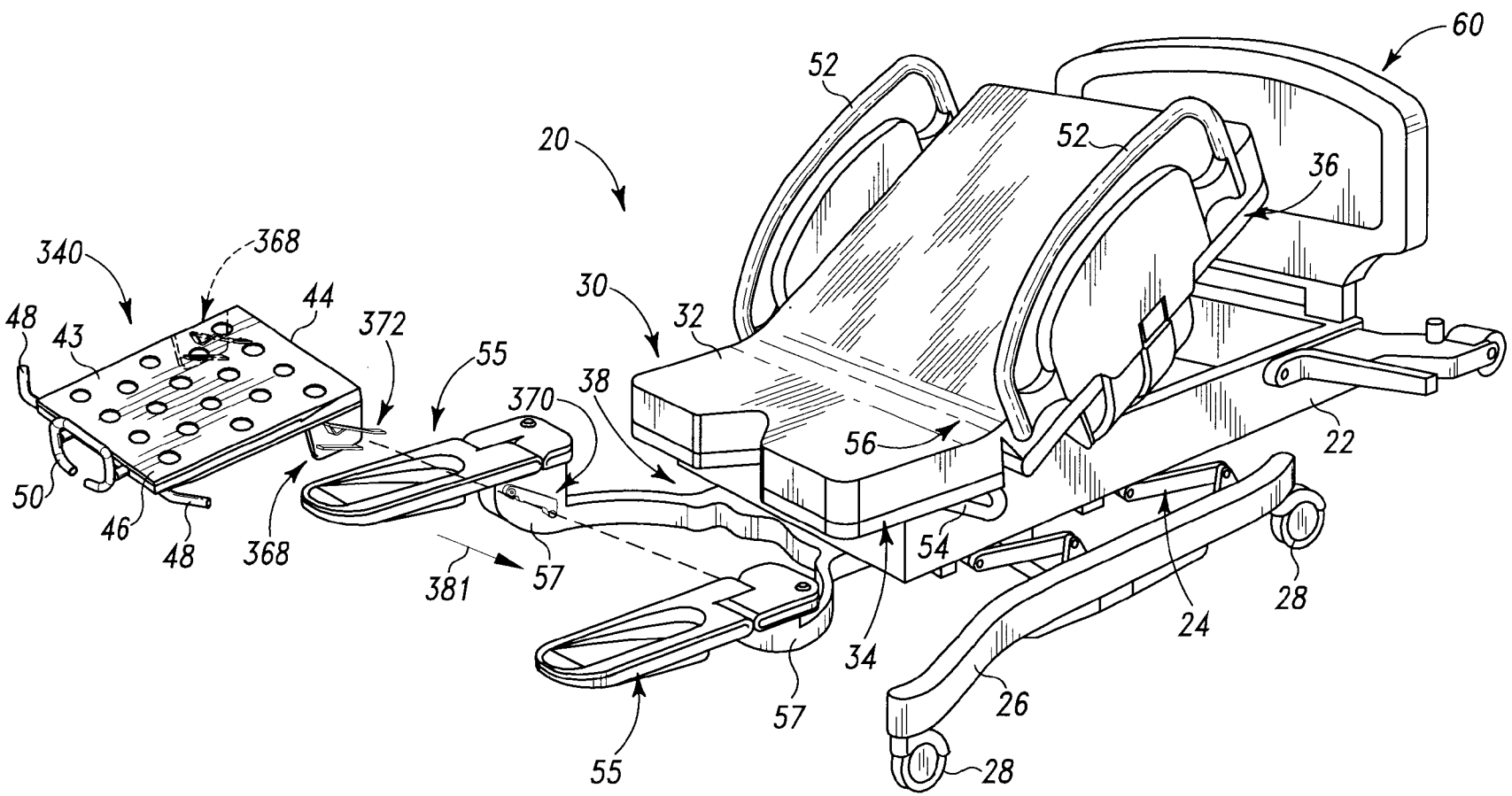
FIG. 13 is a perspective view of another alternative embodiment of the attachment mechanism of the removable foot section of the present invention, the attachment mechanism including a first portion on the foot section of the bed and a second portion on the patient support.
Figure 15:
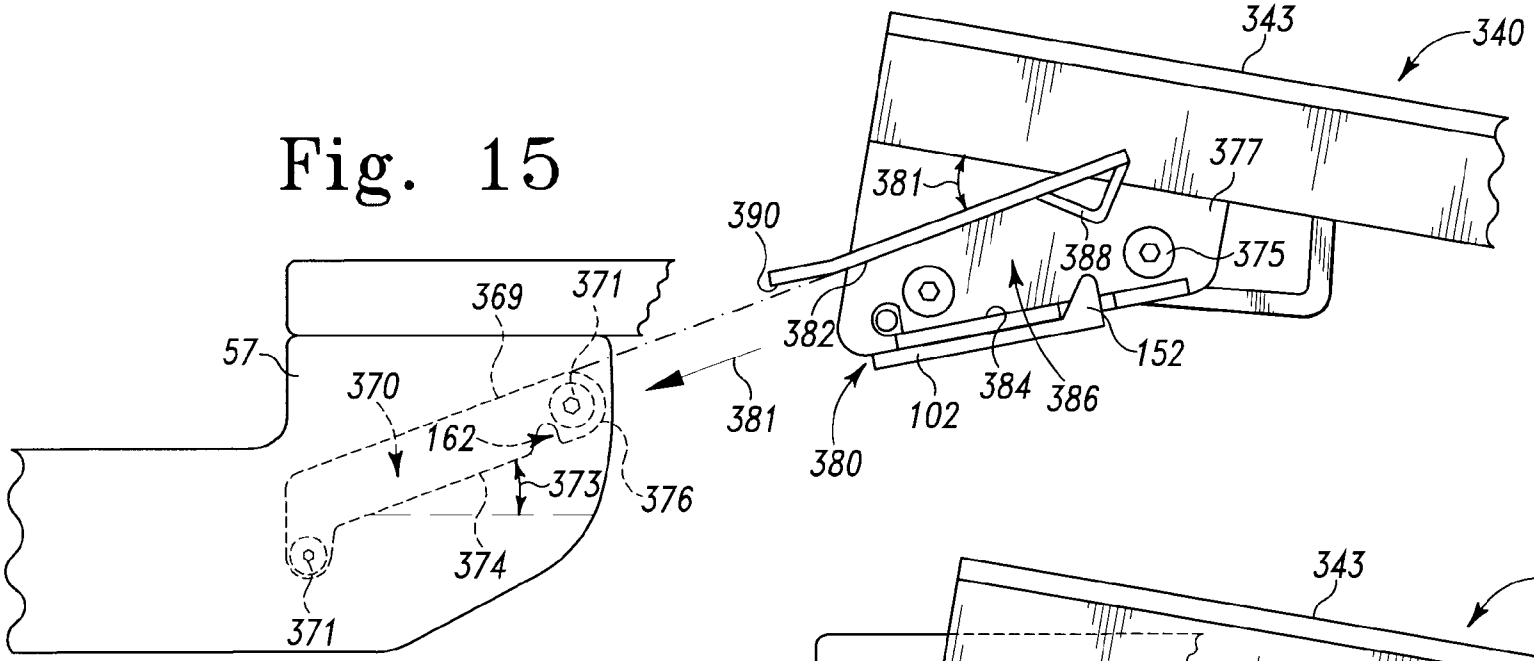
FIG. 15 is a side elevational view of the attachment mechanism of FIG. 13 showing the foot section oriented to be moved in the direction of the arrow toward the patient support to couple the foot section and patient support.

First portion 370 of each attachment mechanism 368 is coupled to support 57 at an upwardly projecting angle as shown in FIG. 13 and FIGS. 15–18. Second portions 372 of each attachment mechanism 368 are similar to guide tracks 80 discussed above except that the guide tracks 380 are aligned at a steeper downward angle illustrated by angle 381 in FIG. 15 relative to top surface 343 of the foot section 340. Therefore, foot section 340 is installed on to patient support 30 by moving foot section 340 toward the patient support 30 at a downwardly directed angle in the direction of arrow 381 as shown in FIGS. 13 and 15. Illustratively, the angle of the path of travel is about 20° downwardly relative to horizontal. It is understood that this angle may be between about 10° and about 80°.

FIGS. 14–18 illustrate the foot section attachment mechanism 368 in more detail. The foot section attachment mechanism 368 includes two guide members 370 coupled to the supports 57 of the main frame 22 by fasteners 371. One guide member 370 is coupled to support 57 on each side of the bed 20, and two guide tracks 380 coupled to the foot section 340, one on each side of the foot section 340. Although the guide members 370 are coupled to the main frame 22 in this particular embodiment, they may very well be coupled instead to the seat section 34 which is rigidly mounted to the main frame 22. Since the construction and the operation of the two guide members 370 and the two guide tracks 380 is similar, only one guide member and one guide track will be described herein in the interest of brevity. It will be understood that the construction and the operation of the other guide member and the other guide track is similar. The two guide members 370 and the two guide tracks 380 are sometimes referred to herein as the cooperating interactive members.

Each guide track 380 includes a lip or ramp portion 390 near its entrance 392. The ramp portion 390 engages a leading edge 376 of the guide member 370 during insertion of the foot section 340 into the bed 20 to direct the guide member 370 into the guide track 380. The guide member 370 includes a first upwardly-facing surface portion 369 on an upper side thereof and a second downwardly-facing surface portion 374 on an underside thereof, both surface portions 369 and 374 extending at an upwardly directed angle 373 relative to a horizontal plane defined by the upwardly-facing surface of the seat section 34. The guide track 380 coupled to the foot section 340 includes a first downwardly-facing surface portion 382 on an upper side thereof extending generally at an angle 381 with respect to the upwardly-facing surface 343 of the foot section 340, and a second upwardly-facing surface portion 384 on a lower side which also extends at a non-parallel angle relative to the upwardly-facing surface 343 of the foot section 340. The first downwardly-facing surface portion 382 and the second upwardly-facing surface portion 384 of the guide track 380 form a diverging guide channel 386 into which the guide member 370 extends when the foot section 340 is inserted into the bed 20 in the direction of arrow 381. The first generally-inclined, downwardly-facing surface portion 382 of the guide track 380 includes a downwardly-projecting ramp portion 388 near its foot end 394 which engages the leading edge 376 of the guide member 370 when the foot section 340 is inserted into the bed 20 to cause the first generally-inclined, downwardly-facing surface portion 382 of the guide track 380 to move away from the first upwardly-facing surface portion 369 of the guide member 370, and to cause the second upwardly-facing surface portion 384 of the guide track 380 to move closer to the downwardly-facing surface portion 374 of the guide member 370. This, in turn, cause the upwardly-facing surface 343 of the foot section 340 to be aligned in substantially the same plane with the seat support 34 of the patient support 30.

The foot section 340 also includes a foot section locking mechanism 100 as best shown in FIGS. 7 and 8 and described above. The foot section locking mechanism 100 locks the foot section 340 to the patient support 30 when the foot section 340 is fully inserted into the bed 20 and the upwardly-facing surface 343 of the foot section 340 is aligned with the seat support 34 of the patient support 30.

Figure 14:
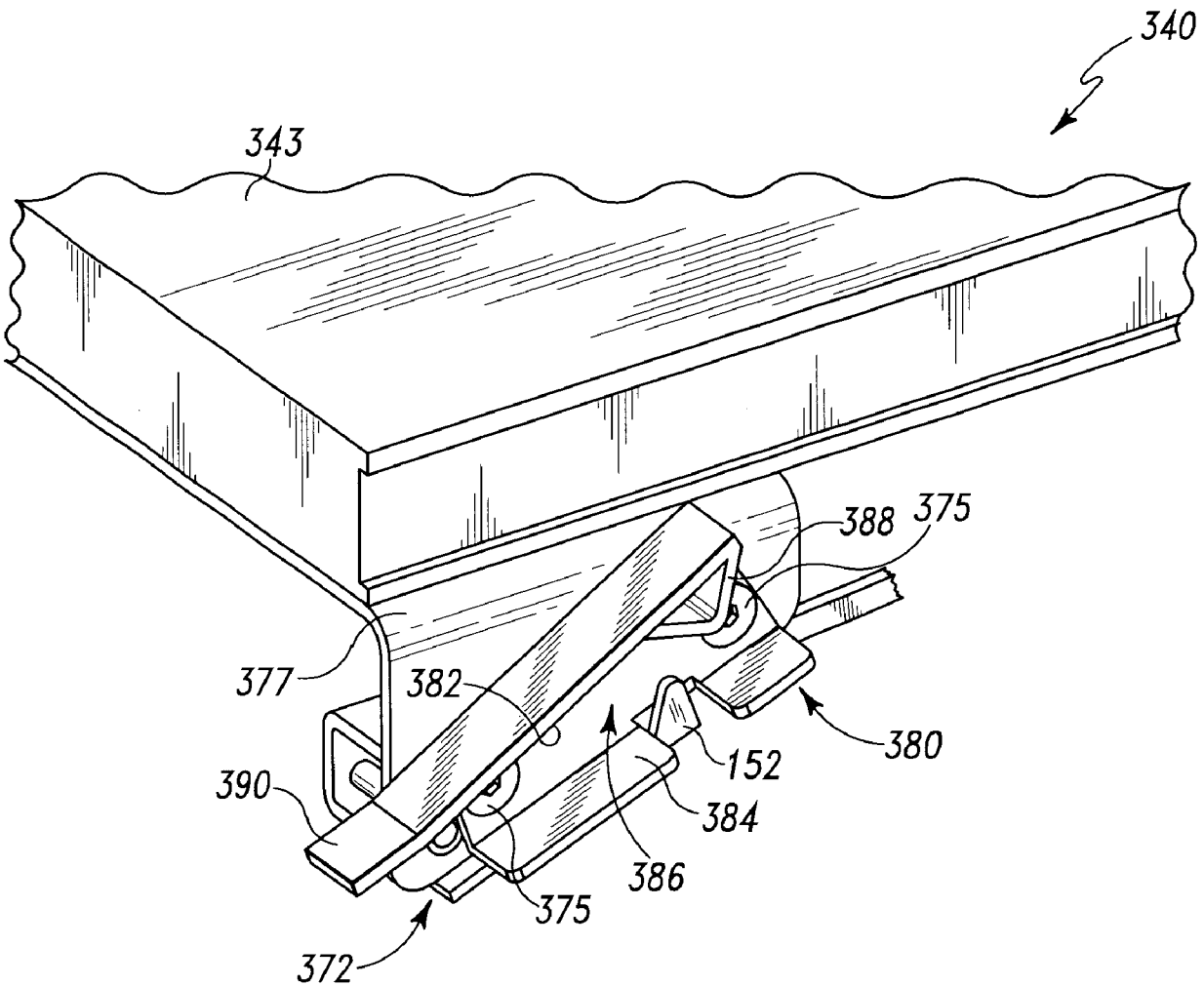
FIG. 14 is a perspective view of the first portion of the attachment mechanism of FIG. 13.

As shown in FIG. 14, the second portion 372 of attachment mechanism 368 is mounted to a downwardly extending plate 377 of foot section 340 by suitable fasteners 375. Plate 377 may be coupled to foot section 340 by suitable fasteners such as bolts, screws, rivets, or by welding.

FIG. 15 illustrates the movement of foot section 340 toward the patient support 30 during installation of the foot section 340. Foot section 340 moves downwardly in the direction of arrow 381 in order to install the foot section 340 on to the patient support 30. Leading ramp portion 390 of track 380 is configured to engage the upper surface 369 or the front surface 376 of guide member 370 as the foot section 340 approaches the guide member 370. Therefore, ramp portion 390 and downwardly facing surface 382 slide over upwardly facing surface 369 so that guide member 370 moves into channel 386. During installation of the foot section 340, top surface 343 is aligned at a plane which is transverse to a plane of seat support 34. The angled top surface 343 therefore provides a visual indication to the caregiver that the foot section 340 is not fully inserted and latched into the patient support 30.

Figure 16:
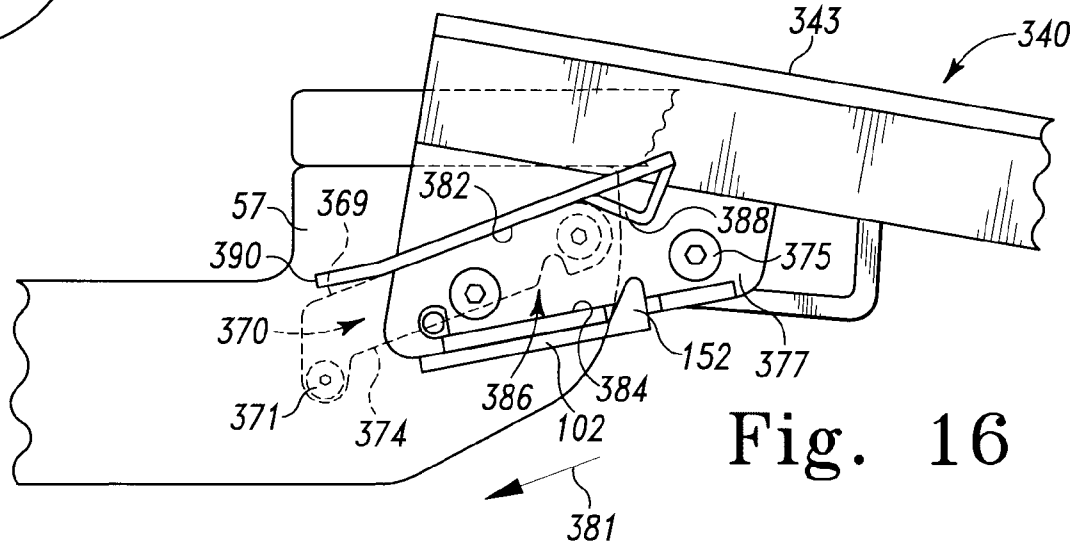
FIG. 16 is a side elevational view similar to FIG. 15 showing the orientation of the foot section relative to the patient support when the first and second portions of the attachment mechanism initially contact.
Figure 17:
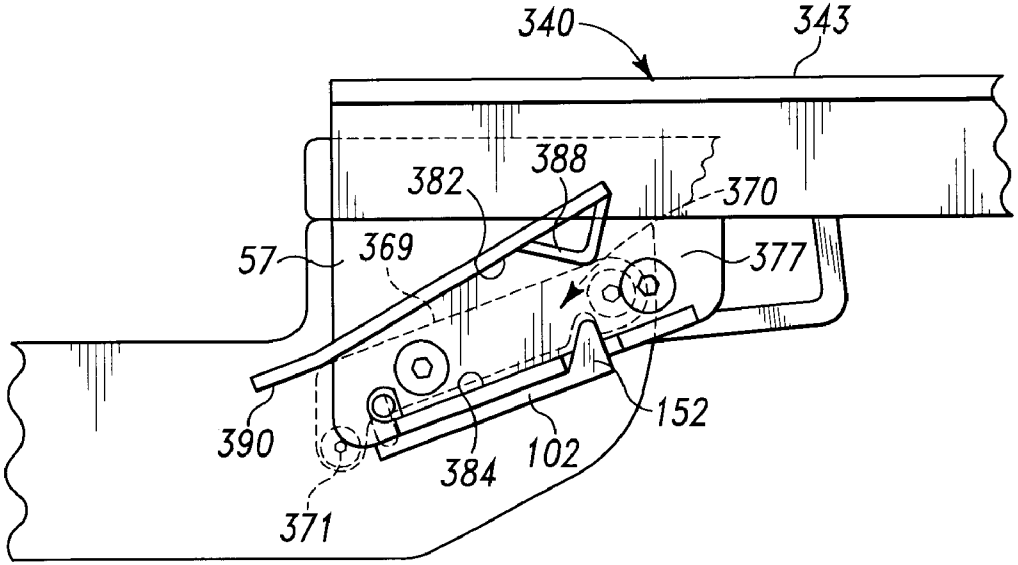
FIG. 17 is a side elevation view similar to FIG. 16 showing the orientation of the foot section relative to the patient support when the first and second portions of the attachment mechanism are coupled to couple the foot section and patient support.

FIG. 16 illustrates the foot section partially inserted on to the guide members 370. The downwardly facing surface 382 engages the upwardly facing surface 369 in the orientation of FIG. 16. Top surface 343 is still aligned in a transverse plane relative to seat section 34 of the patient support 30 to show that the foot section 340 is not latched. As the foot section 340 continues movement in the direction of arrow 381 from the position shown in FIG. 16 to the position shown in FIG. 17, the ramp portion 388 engages the leading edge 376 of guide 370 to move surface 382 upwardly away from surface 369 of guide member 370 as shown in FIG. 17. Triangular portion 152 of latch bar 102 enters the slot 362 formed in guide member 370 to secure the foot section 340 to the patient support 30 as discussed above in detail with reference to the first embodiment. When in the latched position of FIG. 17, the top surface 343 of foot section 340 is located in generally the same plane as the seat section 34 of patient support 30.

Thus, the foot section attachment mechanism 368 is configured such that the upper surface 343 of the foot section 340 will not become parallel with the seat section 34 until the foot section 340 is fully inserted into the opening 38 in the seat section 34. Upon full insertion of the foot section 340 into the opening 38, the locking mechanism 100 automatically locks the foot section 340 to the rest of the bed 20. Therefore, the foot section attachment mechanism 368 provides the caregiver with a visual indication (i.e., the orientation of the upper surface 343 of the foot section 340) regarding whether the foot section 340 is properly attached to the rest of the bed 20.

Figure 18:
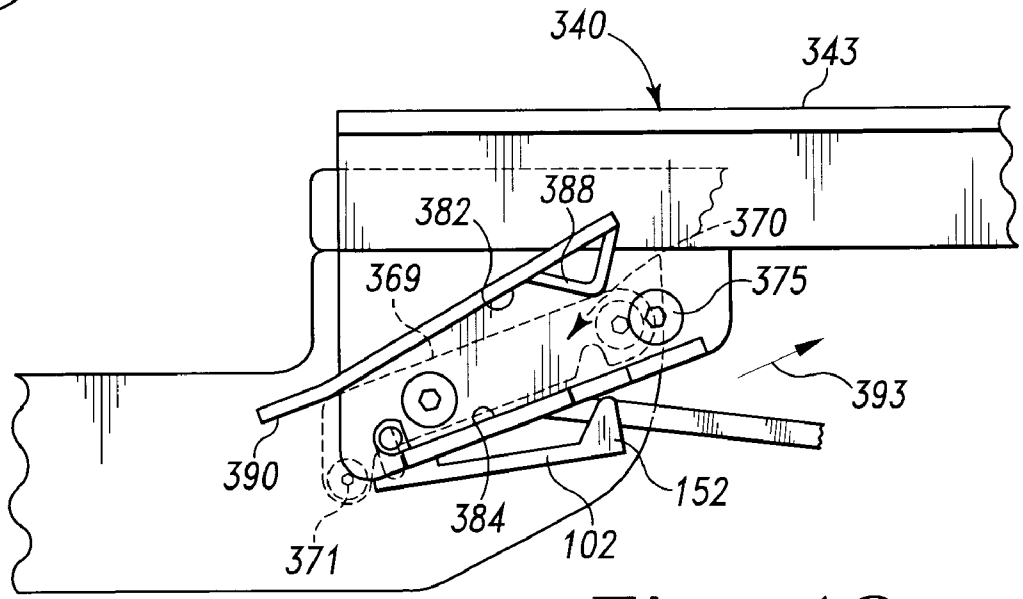
FIG. 18 is a side elevation view similar to FIG. 17 showing the orientation of the foot section relative to the patient support when the foot section is uncoupled from the patient support.

FIG. 18 illustrates the position of latch bar 102 and triangular portion 152 when the release handle 174 is actuated to unlatch the foot section 340. Therefore, when in the unlatched position of FIG. 18, foot section 340 can be removed by moving the foot section 340 at an upwardly directed angle illustrated by arrow 393.

As discussed above, the foot section 340 moves along a path of travel that includes both vertical and horizontal components. Therefore, installation of the foot section 340 is different from the substantially horizontal path of travel of the foot section shown in U.S. Pat. No. 5,926,878 and from the substantially vertical path of travel of the foot section shown, for example, in U.S. Pat. No. 5,226,187 and U.S. Pat. No. 5,157,800.

Although the invention has been described in detail with reference to certain illustrated embodiments, variations and modifications exist within the scope and spirit of the present invention as defined in the following claims.

What is claimed is:

1. A patient support apparatus positioned on a ground surface, the apparatus comprising:

a patient support, a removable section, and a latch having interactive members coupled to the patient support and the removable section, the removable section being movable between a first position wherein the removable section is coupled to the patient support by the interactive members and a second position wherein the removable section is spaced apart from the patient support, the removable section being movable from the second position to the first position along a continuous inclined path of travel having both horizontal and vertical components relative to the ground surface.

2. The apparatus of claim 1, wherein the inclined path of travel is aligned at an angle of between about 10° and about 80° relative to the ground surface.

3. The apparatus of claim 1, wherein the inclined path of travel is aligned at an angle of between about 20° and about 30° relative to the ground surface.

4. The apparatus of claim 1, wherein the patient support has a first generally planar surface and the removable section has a second generally planar surface, and the interactive members are configured to secure the removable section to the patient support such that the second planar surface of the removable section is aligned generally parallel to the first planar surface of the patient support only when the removable section is fully inserted into the patient support and latched to the patient support.

5. The apparatus of claim 4, wherein the latch includes a guide member coupled to the patient support and a guide track coupled to the removable section, the guide track being configured to receiving the guide member when the removable section is coupled to the patient support, the guide track including a ramp portion configured to engage the guide member to cause the second planar surface to move to the generally parallel alignment with the first planar surface as the removable section is inserted the patent support.

6. The apparatus of claim 5, wherein the guide track includes a lip portion located adjacent an entrance of the guide track which is configured to engage the guide member when the removable section is inserted into the patient support to direct the guide member into the guide track.

7. The apparatus of claim 1, wherein the patient support includes a planar support surface, the interactive member coupled to the patient support includes a guide member having a foot end, a head end, and an upper surface, the upper surface being positioned a first distance from the planar support surface at the head end and a second distance from the horizontal plane at the foot end, the first distance being greater than the second distance.

8. The apparatus of claim 7, wherein the guide member further includes a lower surface that is substantially parallel to the upper surface.

9. The apparatus of claim 8, wherein the guide member further includes a recess in the lower surface and the interactive member coupled to the removable section includes a detent positioned in the recess when the removable section and patient support are coupled together.

10. A patient support apparatus comprising:

a patient support having a generally planar support surface defining a horizontal plane, a removable section, platch having interactive members coupled to the patient support and the removable section, an actuator operably configured to move the latch relative to the removable section to an unlatched position to permit removal of the removable section from the patient support, and the removable section being movable between a first position wherein the removable section is coupled to the patient support by the interactive members and a second position wherein the removable section is spaced-apart from the patient support, the removable section being movable from the second position to the first position along a path of travel that intersects the horizontal plane and that also intersects an axis that extends perpendicular to the horizontal plane.

11. The apparatus of claim 10, wherein the interactive member coupled to the patient support includes a guide member having a foot end, a head end, and an upper surface, the upper surface being positioned a first distance from the horizontal plane at the head end and a second distance from the horizontal plane at the foot end, the first distance being greater than the second distance.

12. The apparatus of claim 11, wherein the guide member further includes a lower surface that is substantially parallel to the upper surface.

13. The apparatus of claim 10, wherein the interactive member coupled to the patient support includes a guide member having a foot end, a head end, and a lower surface, the lower surface being positioned a first distance from the horizontal plane at the head end and a second distance from the horizontal plane at the foot end, the first distance being greater than the second distance.

14. The apparatus of claim 13, wherein the guide member further includes a recess in the lower surface and the interactive member coupled to the removable section includes a detent positioned in the recess when the removable section and patient support are coupled together.

15. The apparatus of claim 10, wherein the interactive member coupled to the patient support includes spaced-apart upper and lower surfaces, a head end, and a foot end, the removable section is attached to the patient support by moving the removable section along a path that is substantially parallel to at least one of the upper and lower surfaces.

16. The apparatus of claim 10, wherein the interactive member coupled to the removable section includes spaced-apart supports that define a channel, the interactive member coupled to the patient support is positioned in the channel when the removable section and patient support are coupled together.

17. The apparatus of claim 16, wherein the removable section includes an upper horizontal surface, each of the spaced-apart supports of the interactive member coupled to the removable section include a head end and a foot end, each of the spaced-apart supports being positioned so that the head ends of the supports are farther from the upper horizontal surface of the removable section than the foot ends of the supports.

18. The apparatus of claim 10, wherein the path of travel is aligned at an angle of between about 10° and about 80° relative to the horizontal plane.

19. The apparatus of claim 10, wherein the path of travel is aligned at an angle of between about 20° and about 30° relative to the horizontal plane.

20. The patient support apparatus comprising:

a patient support having a planar support surface, a removable section, and a latch having interactive members coupled to the patient support and removable section, the removable section being movable between a first position wherein the removable section is coupled to the patient support by the interactive members and a second position wherein the removable section is spaced apart from the patient support, the removable section being movable from the second position to the first position along a path of travel including at least one translational component that defines an angle between about 10° and about 80° relative to the planar support surface.

21. The apparatus of claim 20, wherein the inclined path of travel defines an angle between about 20° and about 30° relative to the planar support surface.

22. The apparatus of claim 20, wherein the removable section has a second generally planar surface, and the interactive members are configured to secure the removable section to the patient support such that the second planar surface of the removable section is aligned generally parallel to the planar surface of the patient support only when the removable section is fully inserted into the patient support and latched to the patient support.

23. A patient support apparatus comprising:

a patient support, a removable section, and means for coupling the patient support and removable section so that the removable section is moved along a path of travel having both vertical and horizontal translational components to couple the removable section and the patient support.

24. The apparatus of claim 23, wherein the patient support has a generally planar support surface and the path of travel is aligned at an angle of between about 10° and about 80° relative to the generally planar support surface.

25. The apparatus of claim 23, wherein the patient support has a generally planar support surface and the path of travel is aligned at an angle of between about 20° and about 30° relative to the generally planar support surface.

26. The apparatus of claim 23, wherein the patient support has a first generally planar surface and the removable section has a second generally planar surface, and the coupling means is configured to secure the removable section to the patient support such that the second planar surface of the removable section is aligned generally parallel to the first planar surface of the patient support only when the removable section is fully inserted into the patient support and latched to the patient support.

27. A patient support apparatus comprising:

a patient support having a first generally planar surface, a removable section having a second generally planar surface, and an attachment mechanism including a latch having interactive members coupled to the patient support and the removable section, the attachment mechanism being configured to secure the removable section to the patient support such that the second planar surface of the removable section is aligned generally parallel to the first planar surface of the patient support only when the removable section is fully inserted into the patient support and the interactive members latch the removable section to the patient support.

28. The apparatus of claim 27, wherein the removable section is configured to move between a first position wherein the removable section is coupled to the patient support by the interactive members and a second position wherein the removable section is spaced-apart from the patient support, the removable section being movable from the second position to the first position along a path of travel that intersects a horizontal plane defined by the first generally planar surface and that also intersects an axis that extends perpendicular to the horizontal plane.

29. The apparatus of claim 28, wherein the path of travel is aligned at an angle of between about 10° and about 80° relative to the horizontal plane.

30. The apparatus of claim 28, wherein the path of travel is aligned at an angle of between about 20° and about 30° relative to the horizontal plane.

31. A patient support apparatus comprising:

a patient support having a first generally planar surface, a removable section having a second generally planar surface, means for coupling the removable section to the patient support, the coupling means including a latch having interactive members coupled to the patient support and the removable section, the interactive members being configured to lock the removable section to the patient support in a latched condition and the interactive members being configured to unlock the removable section from the patient support in an unlatched condition; and wherein the second generally planar surface of the removable section is aligned generally parallel to the first generally planar surface of the patient support only when the removable section is fully inserted into the patient support and the interactive members are in the latched condition, and the second generally planar surface automatically forms an intersecting angle with the first generally planar surface when the interactive members are in the unlatched condition to provide a visual indication of the unlatched condition.

32. A patient support apparatus comprising:

a patient support having a first generally planar surface, a removable section having a second generally planar surface, means for coupling the removable section to the patient support such that the second generally planar surface of the removable section is aligned generally parallel to the first generally planar surface of the patient support only when the removable section is fully inserted into the patient support and latched to the patient support, the second generally planar surface forming an intersecting angle with the first generally planar surface when the removable section is unlatched from the patient support, the coupling means including a locking mechanism configured to latch the removable section to the patient support, and an actuator configured to move the locking mechanism relative to the removable section to an unlatched position to permit removal of the removable section from the patient support.

33. The apparatus of claim 31, wherein the removable section is configured to move between a first position when the interactive members are in the latched condition and a second position when the interactive members are in the unlatched condition and the removable section is spaced-apart from the patient support, the removable section being movable from the second position to the first position along a path of travel that intersects a horizontal plane defined by the first generally planar surface and that also intersects an axis that extends perpendicular to the horizontal plane.

34. The apparatus of claim 33, wherein the path of travel is aligned at an angle of between about 10° and about 80° relative to the horizontal plane.

35. The apparatus of claim 33, wherein the path of travel is aligned at an angle of between about 20° and about 30° relative to the horizontal plane.

36. The apparatus of claim 32, wherein the coupling means includes a guide member having a foot end, a head end, and an upper surface, the upper surface being positioned a first distance from the first generally planar surface at the head end and a second distance from the first generally planar surface at the foot end, the first distance being greater than the second distance.

37. The apparatus of claim 36, wherein the guide member further includes a lower surface that is substantially parallel to the upper surface.

38. The apparatus of claim 32, wherein the coupling means includes a guide member having a foot end, a head end, and a lower surface, the lower surface being positioned a first distance from the first generally planar surface at the head end and a second distance from the first generally planar surface at the foot end, the first distance being greater than the second distance.

39. The apparatus of claim 38, wherein the guide member further includes a recess in the lower surface and the means for coupling further includes a detent positioned in the recess when the removable section and patient support are coupled together.

40. The apparatus of claim 32, wherein the coupling means includes an interactive member coupled to the patient support having spaced-apart upper and lower surfaces, a head end, and a foot end, the removable section is attached to the patient support by moving the removable section along a path that is substantially parallel to at least one of the upper and lower surfaces.

41. The apparatus of claim 32, wherein the coupling means includes an interactive member coupled to the removable section having spaced-apart supports that define a channel, the coup ling means further including an interactive member coupled to the patient support which is positioned in the channel when the removable section and patient support are coupled together.

42. The apparatus of claim 41, wherein each of the spaced-apart supports of the interactive member coupled to the removable section include a head end and a foot end, each of the spaced-apart supports being positioned so that the head ends of the supports are farther from the second generally planar surface than the foot ends of the supports.

* * * * *